US011278758B2

(12) United States Patent
Buikema et al.

(10) Patent No.: US 11,278,758 B2
(45) Date of Patent: Mar. 22, 2022

(54) WEIGHTED TRIPLE-BRAIDED EXERCISE ROPE

(71) Applicant: HYPER WEAR, INC., Austin, TX (US)

(72) Inventors: Dirk Buikema, Austin, TX (US); Amos Neal Prescott, Yarmouth, ME (US); Stanley Zanis, Raynardton (CA)

(73) Assignee: HYPER WEAR, INC., Austin, TX (US)

( * ) Notice: Subject to any disclaimer, the term of this patent is extended or adjusted under 35 U.S.C. 154(b) by 90 days.

(21) Appl. No.: 16/817,272

(22) Filed: Mar. 12, 2020

(65) Prior Publication Data

US 2020/0289871 A1 Sep. 17, 2020

Related U.S. Application Data

(60) Provisional application No. 62/819,248, filed on Mar. 15, 2019.

(51) Int. Cl.
*A63B 21/00* (2006.01)
*A63B 21/06* (2006.01)
(Continued)

(52) U.S. Cl.
CPC ..... *A63B 21/151* (2013.01); *A63B 21/0609* (2013.01); *A63B 21/4035* (2015.10);
(Continued)

(58) Field of Classification Search
CPC ..... A63B 21/151; A63B 21/0609; A63B 21/4035; A63B 21/4043;
(Continued)

(56) References Cited

U.S. PATENT DOCUMENTS 3,325,990 A * 6/1967 Laureti ..... D07B 1/02 57/211
4,640,178 A * 2/1987 Kurzbock ..... D07B 1/02 87/1
(Continued)

FOREIGN PATENT DOCUMENTS

JP 3203488 9/2016
KR 10-1078584 11/2011

OTHER PUBLICATIONS

International Search Report and Written Opinion of International application No. PCT/US2020/022366 filing date Mar. 12, 2020; 11 pages, dated Jul. 6, 2020.
(Continued)

*Primary Examiner* — Andrew S Lo
(74) *Attorney, Agent, or Firm* — Baker Botts L.L.P.

(57) ABSTRACT

An exercise rope is disclosed. The exercise rope includes a weighted core. It further includes a first braided layer surrounding the weighted core, the first braided layer having yarns of a first ply. It further includes a second braided layer surrounding the first braided layer, the second braided layer having yarns of a second ply, the second ply being higher than the first ply. It further includes a third braided layer surrounding the second braided layer, the third braided layer having yarns of a third ply, the third ply being higher than the second ply. The second braided layer is coated with an adhesive.

20 Claims, 7 Drawing Sheets

(51) Int. Cl.
*D07B 1/16* (2006.01)
*D07B 1/02* (2006.01)

(52) U.S. Cl.
CPC ..... *D07B 1/02* (2013.01); *D07B 1/162* (2013.01); *A63B 21/4043* (2015.10); *D07B 2201/102* (2013.01); *D07B 2201/1096* (2013.01)

(58) Field of Classification Search
CPC ..... A63B 2208/0204; A63B 23/03541; D07B 1/162; D07B 1/02; D07B 2201/102; D07B 2201/1096; D07B 2207/404; D07B 2201/2092; D07B 1/148; D07B 2201/2087; D07B 2401/205; D07B 2201/2064
See application file for complete search history.

(56) References Cited

U.S. PATENT DOCUMENTS 5,852,926 A * 12/1998 Breedlove ..... D07B 1/025 57/210
6,321,520 B1 11/2001 De Angelis
6,397,574 B1 * 6/2002 De Angelis ..... D07B 1/025 57/251
6,563,107 B2 * 5/2003 Danisch ..... G01B 11/18 250/227.14
7,137,483 B2 * 11/2006 Kato ..... B66B 7/06 187/251
7,399,018 B1 * 7/2008 Khachaturian ..... B66C 1/12 294/74
7,549,399 B2 * 6/2009 Hurwitz ..... A01K 27/006 119/796
7,568,418 B2 * 8/2009 Kijesky ..... A62B 1/14 87/6
7,954,410 B2 6/2011 Prescott et al.
8,197,074 B2 * 6/2012 Hurwitz ..... G02B 5/124 359/529
8,695,317 B2 * 4/2014 Erlendsson ..... D07B 5/005 57/6
8,715,140 B1 * 5/2014 Gertz ..... A63B 21/16 482/35
8,883,302 B2 * 11/2014 Zachariades ..... B32B 27/02 428/357
9,265,984 B2 * 2/2016 Huber ..... A63B 23/03541
9,845,571 B2 * 12/2017 Kirth ..... D04C 3/12
10,918,900 B2 * 2/2021 Anaya ..... A63B 21/0557
2005/0217748 A1 * 10/2005 Ikegami ..... D07B 1/02 139/388
2007/0169457 A1 * 7/2007 Kijesky ..... A62B 1/14 57/210
2007/0207905 A1 * 9/2007 Winston ..... A63B 21/0084 482/126
2010/0162882 A1 * 7/2010 Shakespeare ..... D04C 1/12 87/6
2010/0294114 A1 * 11/2010 Prescot ..... D07B 1/02 87/6
2011/0003150 A1 * 1/2011 Measom ..... B29C 70/20 428/367
2012/0160082 A1 * 6/2012 Erlendsson ..... D07B 1/02 87/6
2014/0000233 A1 * 1/2014 Chou ..... D07B 1/142 57/237
2014/0113777 A1 4/2014 Pahl
2014/0309088 A1 10/2014 Buikema
2014/0345098 A1 * 11/2014 Erlendsson ..... D04C 1/12 28/245
2017/0028241 A1 2/2017 Nurse
2017/0203145 A1 * 7/2017 Proudian ..... A63B 21/0609
2017/0328001 A1 * 11/2017 Kirth ..... D07B 1/025
2017/0368405 A1 12/2017 Matos
2019/0119850 A1 * 4/2019 Erlendsson ..... D07B 1/162

OTHER PUBLICATIONS

"Novabraid Performance by Design—Fast Rope" by Novatec Braids Ltd. At www.novabraid.com, 1 page, printed Feb. 11, 2019.
International Preliminary Report and Written Opinion of International application No. PCT/US2020/022366; dated Sep. 30, 2021, 8 pages.

* cited by examiner

WEIGHTED TRIPLE-BRAIDED EXERCISE ROPE

PRIORITY CLAIM

The present application claims priority to U.S. Provisional Application Ser. No. 62/819,248 filed Mar. 15, 2019, the contents of which is incorporated by reference herein in its entirety.

FIELD OF THE INVENTION

The present disclosure relates to the field of weight training and physical conditioning. More specifically, the present disclosure relates to an unanchored, weighted fitness device.

BACKGROUND

The use of ropes in physical fitness applications is currently known in the art. Current ropes used for physical fitness, sometimes called "battle ropes" or "heavy ropes", can be purchased in various diameters of thickness and length. Typically, the longer a common battle rope, the heavier the rope is overall. A common battle rope is approximately 30 to 50 feet long and 1.5 to 2 inches in diameter.

Battle ropes can be constructed from different natural and artificial materials. For example, battle ropes are typically constructed of three strands of yarn, twisted together. A disadvantage of this construction method is that the fibers from the yarn will shed during use, leaving behind debris. Further, battle ropes are typically made using two different lay methods (i.e., different methods of twisting the yarn to form a rope). Battle ropes are typically either soft laid or hard laid. Both these construction methods may have disadvantages. The twisted soft-lay construction method results in a rope that may unlay or untwist, and the hard-lay construction method results in a rope that is stiff, thereby limiting the range of potential exercise activity.

For physical exercise, battle ropes are typically anchored to a rigid, stationary object, such as a wall, post, or floor, and use of the battle rope is confined to the point of anchor. The user grasps at least one end of the rope and moves the length of the rope in up-and-down, side-to-side, or circular motions, causing the rope to oscillate, resisting the user's efforts to move the rope. The user may also slam the battle rope repeatedly on the ground during the exercise, and the impact with the ground causes a loud noise.

Proper use of a battle rope involves keeping slack in the rope. However, a disadvantage of an anchored battle rope system is that users often misuse the battle rope by pulling back on the battle rope and tightening the slack. Misuse of this kind exerts pressure at the anchor point and stresses the rope, increasing the risk that both will fail. Furthermore, users who pull back on battle ropes may not be getting the full fitness benefits of a battle rope exercise because the user's muscles are less engaged than when the user has the correct form. This misuse can cause injuries to the user.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Exercise ropes can be used for strength training, anaerobic, and aerobic exercise, and provide a high-intensity, whole-body workout. Exercise ropes engage the muscle groups in a user's upper body, including shoulders, biceps, triceps, latissimus dorsi, and pectoral muscles. The core is also engaged in order to stabilize the body. During training, a user holds at least one end of the exercise rope and uses strength to lift the rope into the air. The exercise rope of the present disclosure may be anchorless, and allows for dynamic, ever-changing movements, such as undulating or free-form motion in the air. It may be used for a variety of exercises, including, for example, being used as a weighted jump rope. Furthermore, a user can use the exercise rope to perform a pulling exercise, where a user alternates hands to pull along the length of the exercise rope or slides the weighted rope along the ground. A user may also use the exercise rope with a partner, either with one rope or more than one rope.

A weighted, triple-braided exercise rope is disclosed. The rope includes a weighted core, and a first braided layer, a second braided layer, and a third braided layer around the weighted core. The rope may be longer or shorter, thicker or thinner, heavier or lighter, depending on the needs of a user. The triple-braided exercise rope of the present disclosure offers all the benefits of battle rope training, but in less space, and without the need for an anchor point. As explained in more detail below, the exercise rope makes less noise and sheds fewer material during use, offers greater flexibility, and provides a far greater variety of exercises. The exercise rope may allow for use in more confined spaces than conventional battle ropes because the weighted core makes the rope heavier. Because the weighted rope is heavier, the rope may be shorter than conventional battle ropes. The rope may also be thinner than conventional battle ropes. It may also provide a more failure-resistant and lower-stress design because it does not require use with an anchor point, and, when no anchor point is used, a user does not pull back on the rope to exert stress on the midpoint of the rope. Further, it may provide a safer and better workout for a user because, when unanchored, a user, unable to pull back on the rope, is required to use better form, allowing for more consistently engaged muscles and a reduction in injuries. The exercise rope of the present disclosure also provides for a quieter experience because it allows for exercises where the rope does not get slammed repeatedly on the ground during use. The braided design sheds less material and is more flexible than a twisted battle rope.

Embodiments of the present disclosure and its advantages are best understood by referring to FIGS. 1 through 6, where like numbers are used to indicate like and corresponding parts.

Figure 1A:
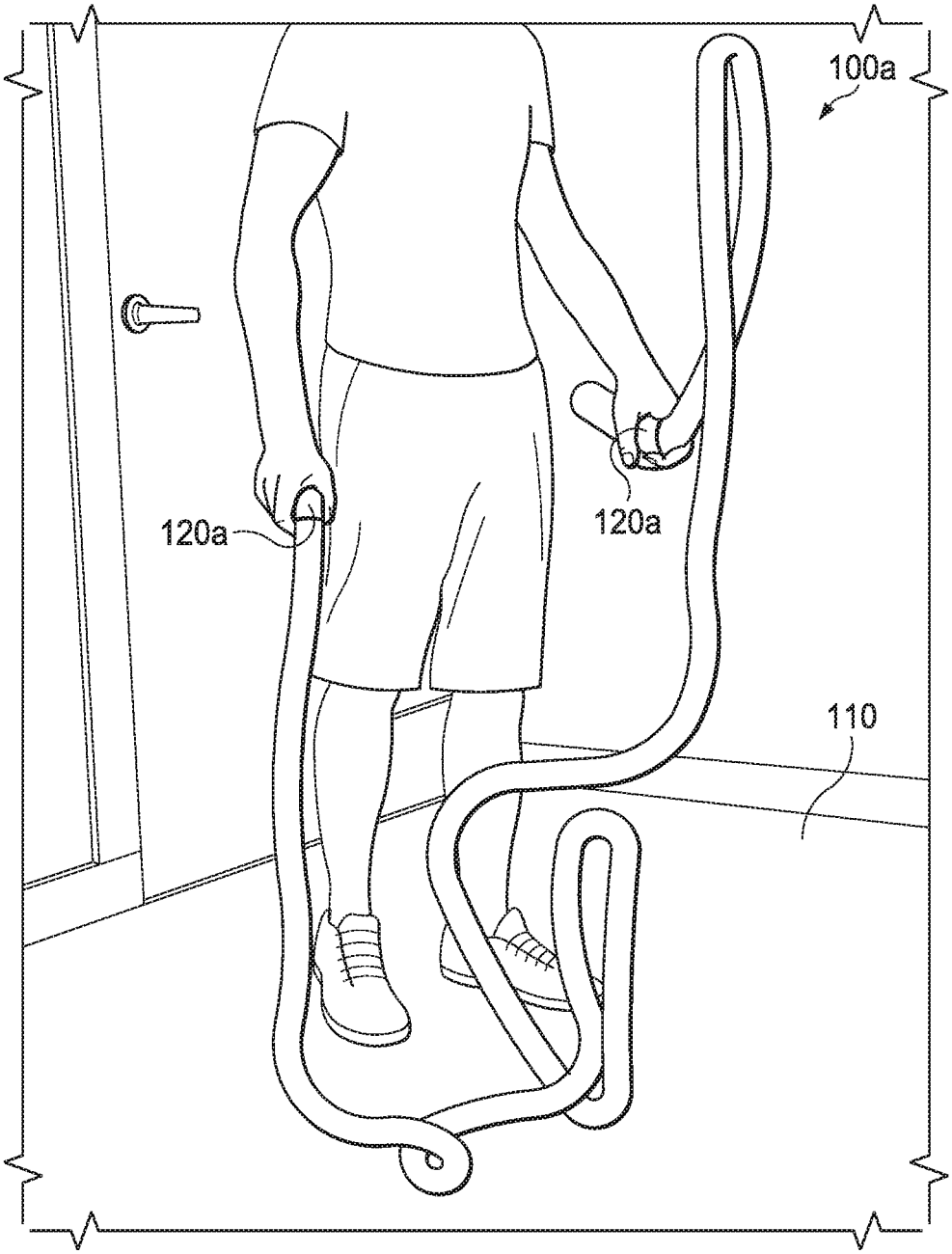
FIGS. 1A-1C are a perspective view of a weighted, triple-braided exercise rope in use.
Figure 1B:
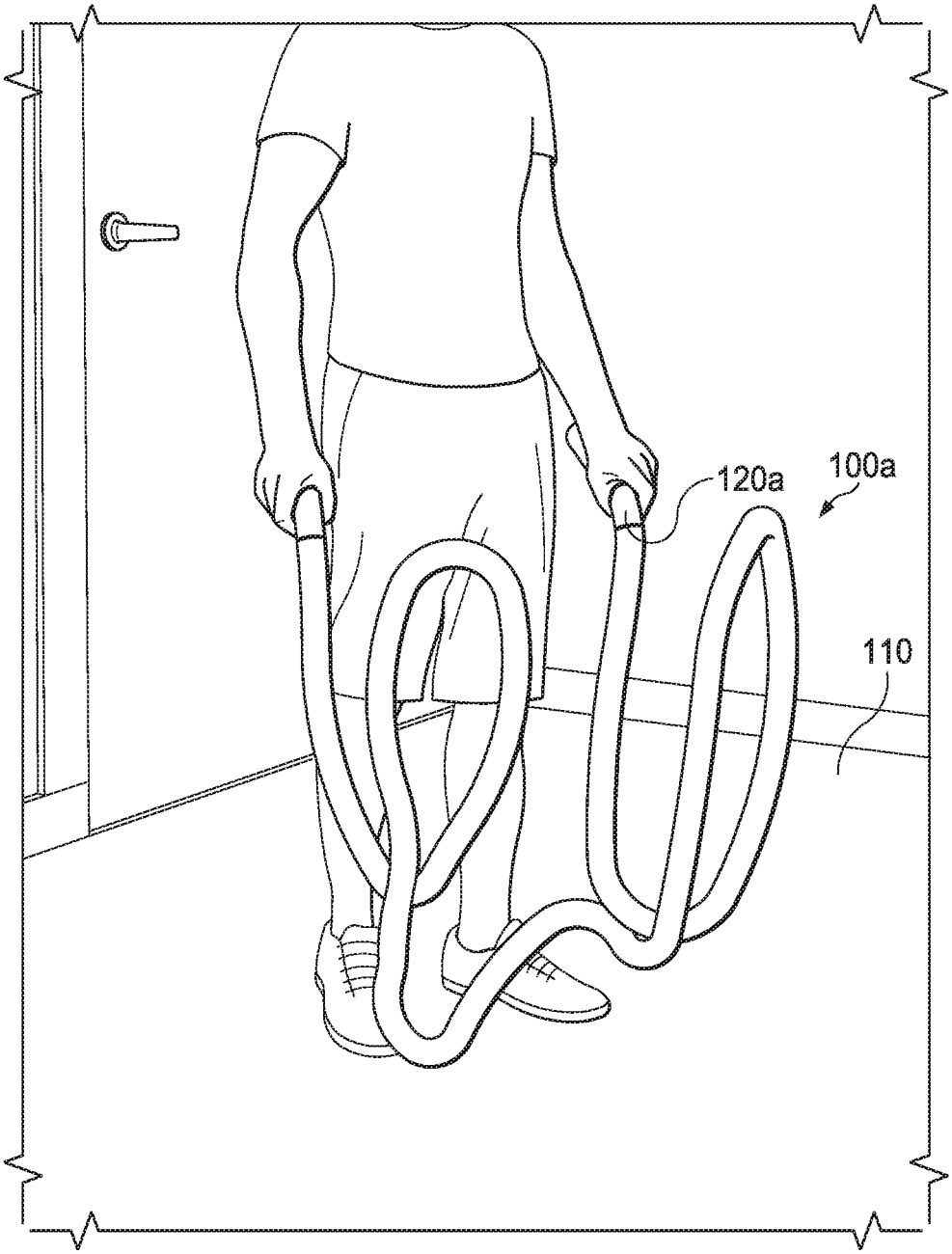
Figure 1C:
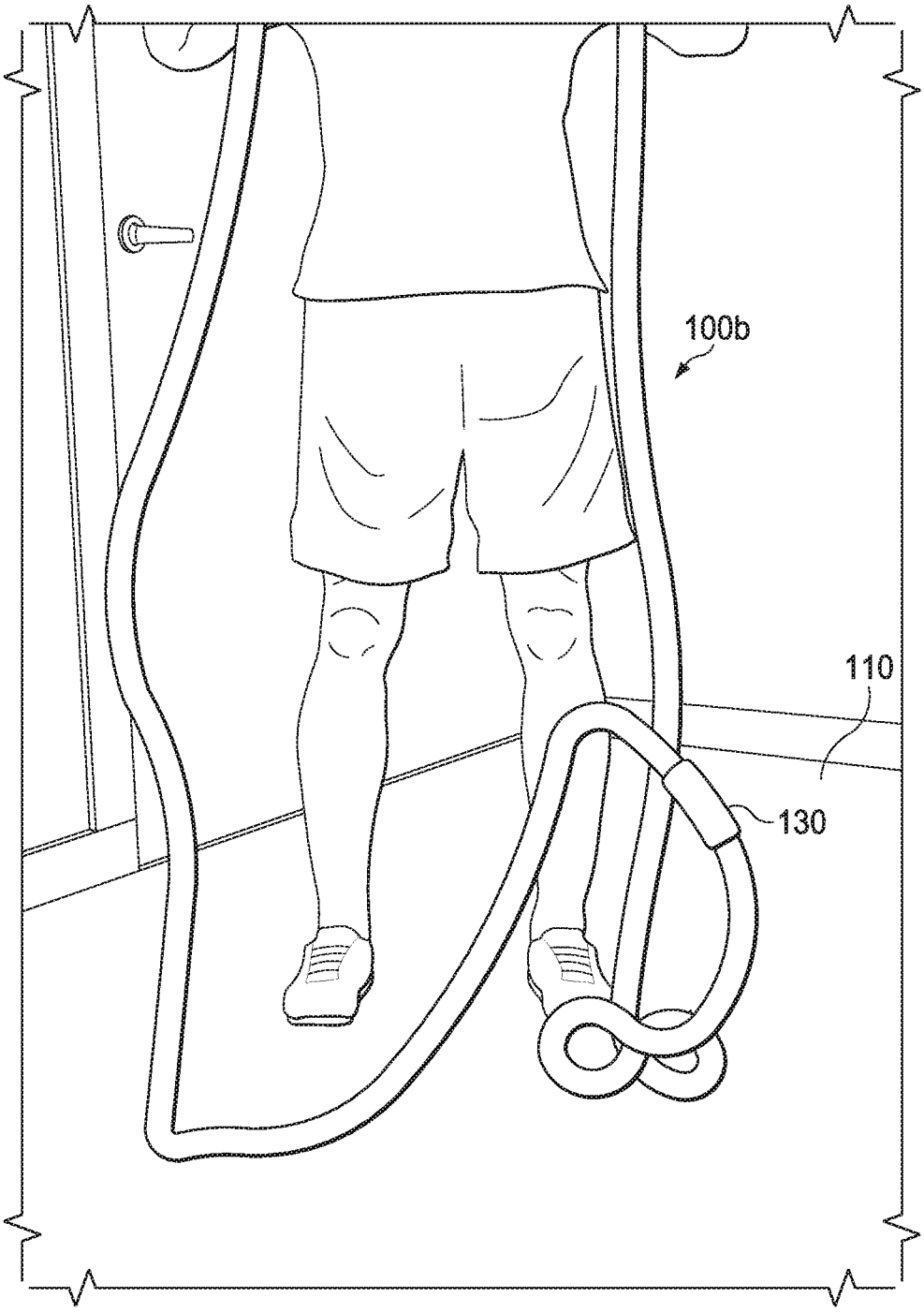

FIGS. 1A-1C are a perspective view of a weighted, triple-braided exercise rope in use. FIGS. 1A and 1B both show exercise rope 100*a* in use, at different stages of motion. The exercise rope 100*a* does not require an anchor and may be used in a free-form motion. For example, a user may lift exercise rope 100*a* off ground 110 and oscillate it while exercise rope 100*a* hovers off ground 110. Or, the user may move the length of exercise rope 100*a* in up-and-down, side-to-side, and circular motions. The user may also perform a halo exercise, where the user lifts its arms over its head and moves them in a circular motion. Another exercise that rope 100*a* may be used for is performing a pulling exercise, where a user alternates hands to pull along the length of the exercise rope 100*a* or slides exercise rope 100*a* along ground 110. A user may also use exercise rope 110*a* with a partner, either with one rope or more than one rope, to perform additional exercises. Further, users may use exercise rope 100*a* as a weighted jump rope.

While exercise rope 100*a* may be used similarly to a conventional battle rope with an anchor, exercise rope 100*a* is not confined to an anchor point during use. Rather, exercise rope 100*a* may be used anywhere with adequate space, such as an area as small as four-feet by four-feet. Another advantage of exercise rope 100*a* needing no anchor point is that users will have a more difficult time misusing exercise rope 100*a* during an exercise. Exercise rope 100*a* forces the user to have better form because the user cannot lean back into a bad form position, as with prior art anchored battle ropes. Because a user stands upright when using exercise rope 100*a*, fewer user injuries may result because less improper strain is exerted on the user's muscles, such as strain that causes shoulder injuries. And, the user engages more muscles with the ability to locomote using whole body, fluid movements, resulting in a more effective workout. Unlike conventional battle ropes, where a user may do abrupt or jerking motions, battle rope 100*a* of the present disclosure facilitates smoother movements. Furthermore, when unanchored, there is no anchor point to fail, and exercise rope 100*a* does not have the same strain in the center as an anchored rope in use.

Exercise rope 100*a* may contain two handles 120*a*, that may be made of a plastic, such as polyethylene, polypropylene, or polyvinyl chloride, a synthetic material, or a synthetic rubber, such as neoprene. Attaching handles 120*a* to the end of exercise rope 100*a* may involve seizing the ends of exercise rope 100*a* with twine and then coating the twine and end of exercise rope 100*a* with polyurethane. Handles 120*a* may then be attached to the ends of exercise rope 100*a* by applying heat. For example, handles 120*a* may be attached to the ends of exercise rope 100*a* via a shrink-wrapping process. The heat applied may be between approximately 350 degrees Fahrenheit and approximately 400 degrees Fahrenheit. Additionally, handles 120*a* may convey information to the user, such as the weight of exercise rope 100*a*, the length of exercise rope 100*a*, other product information, and/or branding information such as a logo. For example, handles 120*a* may be color-coded to indicate the weight and/or length of exercise rope 100*a*.

Because exercise rope 100*a* does not need to be slammed on ground 110, it may impact ground 110 less frequently than a conventional battle rope. This makes it quieter to use. Additionally, because exercise rope 100*a* has less impact with ground 110, in conjunction with the braided design, exercise rope 100*a* also has less loss of material, such as fibers, during use. This results in a cleaner, quieter workout, which may be advantageous to users and sports facilities.

In some embodiments, as shown in FIG. 1C, exercise rope 100*b* may contain sleeve 130. Sleeve 130 may cover the entire length of exercise rope 100*b*. It may also cover only portions of exercise rope 100*b*. For example, as shown in FIG. 1C, sleeve 130 covers an area surrounding the midpoint of exercise rope 100*b*. This may help the user identify the midpoint. Additionally, sleeve 130 may convey information to the user, such as the weight of exercise rope 100*b*, the length of exercise rope 100*b*, other product information, and/or branding information such as a logo. For example, sleeve 130 may be color-coded to indicate the weight and/or length of exercise rope 100*b*. Sleeve 130 may be made of a plastic, such as polyethylene, polypropylene, or polyvinyl chloride, a synthetic material, or a synthetic rubber, such as neoprene. Sleeve 130 may be secured to exercise rope 100*b* by applying heat. For example, sleeve 130 may be secured to exercise rope 100*b* via a shrink-wrapping process. The heat applied may be between approximately 350 degrees Fahrenheit and approximately 400 degrees Fahrenheit. Sleeve 130 may include handles or eyes on each end.

Exercise rope 100*a* or 100*b* may be different lengths, ranging from approximately six feet to approximately 30 feet. The length of exercise rope 100*a* or 100*b* may be selected based on the needs of the user. For example, a child might need a shorter, lighter rope, while a body builder may want a longer, heavier rope. A length may be chosen that allows a user to lift exercise rope 100*a* or 100*b* off ground 110, while also providing sufficient resistance. In some embodiments, exercise rope 100*a* or 100*b* may be approximately 10 feet long. By way of example, this embodiment may be used for gym class in school or as a weighted jump rope for all age ranges. In another embodiment, exercise rope 100*a* or 100*b* may be approximately 20 feet long. In another embodiment, exercise rope 100*a* or 100*b* may be approximately 25 feet long. This 25-foot embodiment may be heavier than the 10-foot or 20-foot embodiments and may be the preferred embodiment for those users desiring higher resistance.

Exercise rope 100*a* or 100*b* may have different masses per foot of rope, ranging from approximately one pound per foot of rope to approximately 2.5 pounds per foot of rope. In some embodiments, the mass is approximately 1.5 pounds per foot of rope. The mass can be increased or decreased by modifying the weighted core of exercise rope 100*a* or 100*b*, as explained in more detail with reference to FIG. 4.

Exercise rope 100*a* or 100*b* may have different diameters, ranging from approximately one inch to approximately 2.5 inches. In some embodiments, the diameter is approximately 1.25 inches. The diameter of exercise rope 100*a* or 100*b* may increase or decrease depending on the weighted core or the properties of each layer of exercise rope 100*a* or 100*b*, as explained in more detail with reference to FIG. 4.

Figure 2:
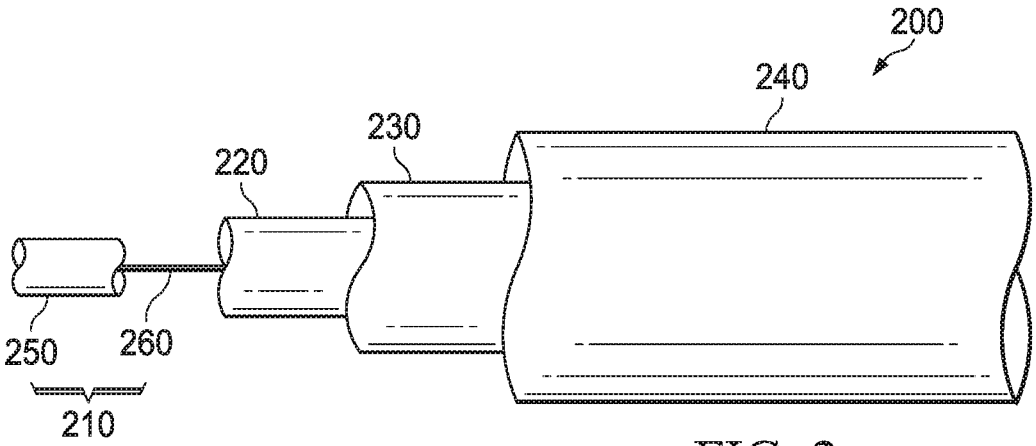
FIG. 2 is a perspective view of a triple-braided exercise rope, showing each layer of the rope.

FIG. 2 is a perspective view of a triple-braided exercise rope 200 including weighted core 210, first braided layer 220, second braided layer 230, and third braided layer 240. Exercise rope 200 may have the properties and uses of exercise ropes 100*a* and 100*b* shown in FIGS. 1A-C. Exercise rope 200 may be triple braided, with weighted core 210 surrounded by first braided layer 220, which is surrounded by second braided layer 230, and third braided layer 240 surrounding second braided layer 230. Triple-braided exercise rope 200 may provide more flexibility as compared to a twisted battle rope. Furthermore, triple-braided exercise rope 200 sheds less material during use than a twisted battle rope made of fibers.

Figure 4:
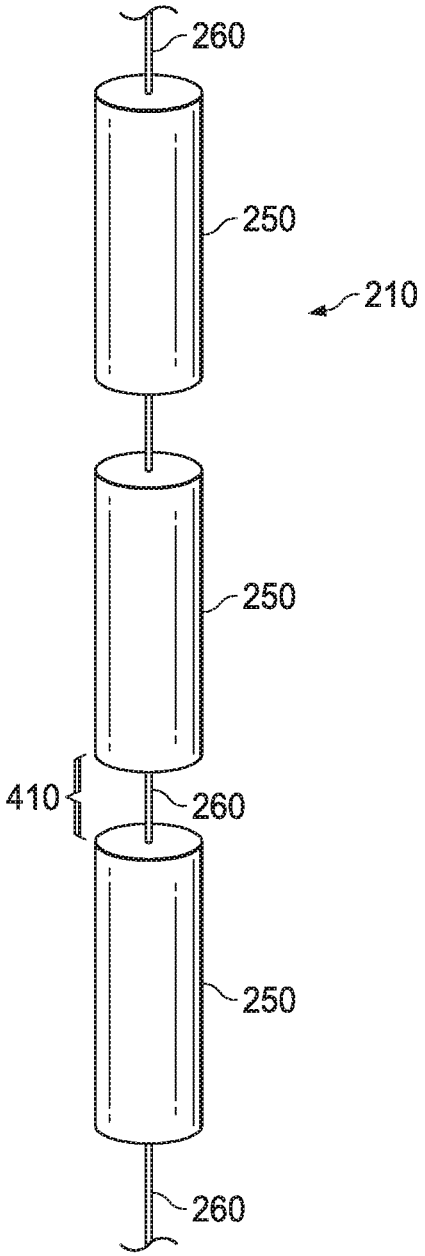
FIG. 4 is a perspective view of the weighted core of FIG. 3.

Weighted core 210 may be formed of weights 250 on monofilament 260, as shown in more detail in FIG. 4. Weights 250 may be arranged in series lengthwise along monofilament 260 and may be evenly spaced along monofilament 260, which runs through the center of weights 250. In embodiments, weighted core 210 may be formed by extruding a wire over monofilament 260 and crimping the wire to form equally spaced segments held together by monofilament 260. In these embodiments, the extruded wire may be of a material with a lower melting temperature than monofilament 260 such that monofilament 260 remains solid during the extrusion process.

Weights 250 may be formed of any material having a density of between approximately 0.1 $lb/in^3$ and approximately 0.6 $lb/in^3$, including metals such as aluminum, zinc, iron, copper, silver, lead, bismuth, gold, or alloys thereof. In some embodiments, weights 250 may be formed of a material having a density of approximately 0.4 $lb/in^3$, such as lead. Monofilament 260 may be formed of any continuous fiber having a high tensile strength that may fit through the center of weights 250 or over which a wire can be extruded, including, but not limited to, polyester, nylon, polyvinylidene fluoride, polyethylene, polyethylene terephthalate, ultra-high-molecular-weight polyethylene (UHMWPE), or aramids.

Weighted core 210 is surrounded by first braided layer 220. First braided layer 220 may be made of multiple twisted strands of yarn interwoven together to form a braid. Different numbers of parallel twisted strands of yarn may be interwoven together to make braids of different plies. The term "ply" refers to how many parallel strands of yarn are interwoven together. For example, first braided layer 220 may be between one ply and three ply, inclusive, meaning it is formed by between one and three twisted strands of yarn that are interwoven together. First braided layer 220 may be interwoven tightly to close gaps between the interwoven yarns. For example, multiple strands of yarn may be braided over weighted core 210 to form a tight cover around weighted core 210. First braided layer 220 may be made of yarns of a first material. The first material may be a material that has high strength and durability, such as a synthetic material. For example, the first material may be a fluoropolymer, a material made from polytetrafluoroethylene, polyester, or nylon.

Second braided layer 230 surrounds the outer diameter of first braided layer 220. For example, second braided layer 230 may be braided over first braided layer 220. Second braided layer 230 may be interwoven tightly to close gaps between the interwoven yarns. Second braided layer 230 may be made of yarns of a second material. For example, the second material may be a twisted high strength abrasion resistant yarn. Second braided layer 230 may be coated with an adhesive, shown in FIG. 3 as element 270, to prevent second braided layer 230 from rupturing through third braided layer 240 when exercise rope 200 is in use. Adhesive 270 may be a material that has high cohesive strength, flexibility, and the ability to adhere to the second braided layer, such as glue, polyurethane, or cyanoacrylate.

Third braided layer 240 surrounds the outer diameter of second braided layer 230. For example, third braided layer 240 may be braided over second braided layer 230 after adhesive 270 is applied to the outside of second braided layer 230 to bond the two layers together. Third braided layer 240 may be interwoven tightly to close gaps between the interwoven yarns. Third braided layer 240 may be made of yarns of a third material. For example, the third material may be an abrasion resistant, low stretch, UV-resistant solution of dyed yarn strands. In embodiments, half of these strands of yarn may be twisted in a clockwise direction and the other half of these strands of yarn may be twisted in a counter clockwise direction.

Figure 3:
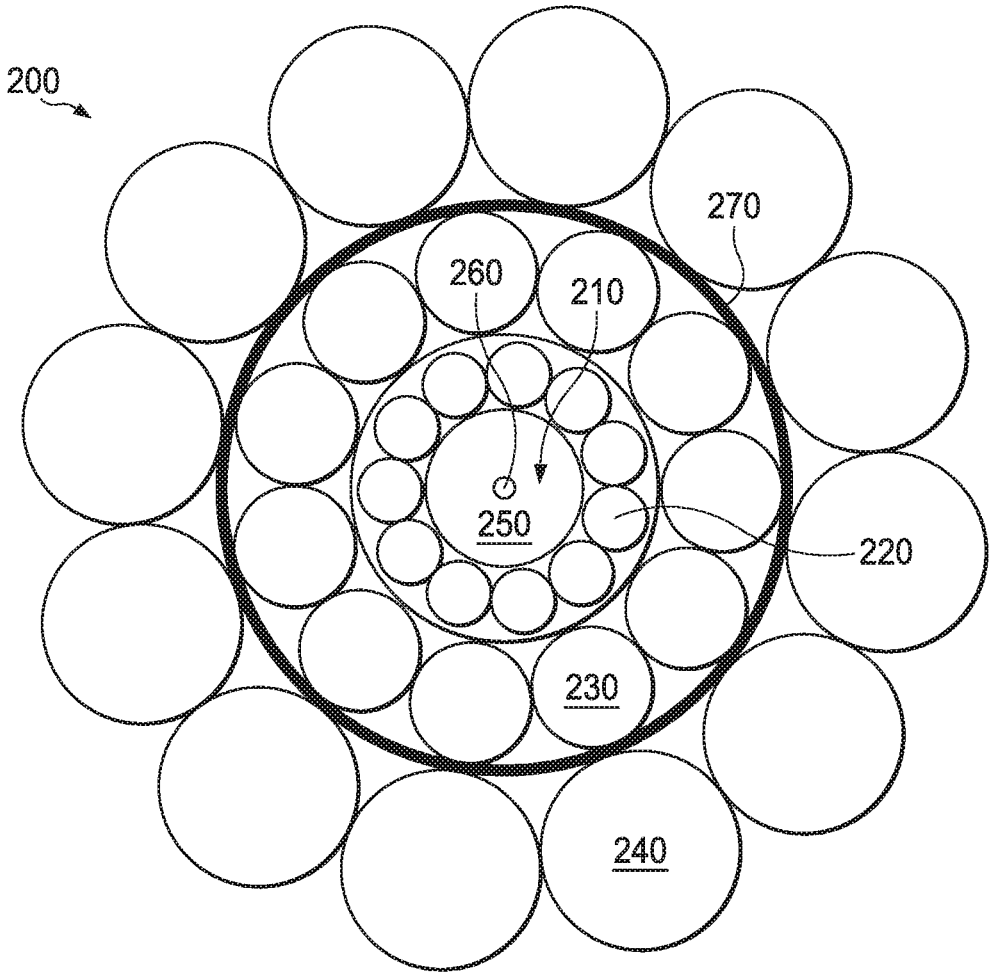
FIG. 3 is a cross-sectional view of the weighted, triple-braided exercise rope of FIG. 2, showing the weighted core, the first braided layer, the second braided layer, and the third braided layer.

FIG. 3 is a cross-sectional view of weighted, triple-braided exercise rope 200, showing weighted core 210, first braided layer 220, second braided layer 230, and third braided layer 240. Each of braided layers 220, 230, and 240 may have different thicknesses. For example, third braided layer 240 may have thicker braids than second braided layer 230, which may have thicker braids than first braided layer 220. The thickness depends on the ply of the material used to make the braided layer.

Exercise rope 200 includes weighted core 210 in the center, as shown and described in reference to FIGS. 2 and 4. Weighted core 210 may contain weights 250 on monofilament 260. In one embodiment, monofilament 260 may fit through the center of triple-braided exercise rope 200. First braided layer 220 covers weighted core 210 and may be made of a first material having a first ply. Second braided layer 230 may be made of a second material and may have a second ply, where the second ply may be higher than the first ply, resulting in a thicker second braided layer 230. Second braided layer 230 may be coated with adhesive 270 to prevent second braided layer 230 from rupturing through third braided layer 240 when exercise rope 200 is in use. Adhesive 270 may be a material that has high cohesive strength, flexibility, and the ability to adhere to second braided layer 230, such as glue, polyurethane, or cyanoacrylate. Third braided layer 240 may be made of a third material and may have a third ply, where the third ply may be higher than the second ply, resulting in a thicker third braided layer 240.

Using a tighter braiding technique reduces the space between each yarn in a layer. By way of example, first braided layer 220 is shown having eleven yarns. By tightening the braiding, the distance between each of these eleven yarns decreases. A tighter braid may increase the stiffness of exercise rope 200, but exercise rope 200 will be more flexible than a twisted battle rope. A tighter braid may help prevent failure of exercise rope 200, such as one of the layers rupturing through one of the other layers.

FIG. 4 is a perspective view of a weighted core 210 shown in FIGS. 2 and 3. Weighted core 210 may include weights 250 on monofilament 260. Weights 250 may be arranged in series lengthwise along monofilament 260. Weights 250 may be formed of any material having a density of between approximately 0.1 $lb/in^3$ and approximately 0.6 $lb/in^3$, including metals such as aluminum, zinc, iron, copper, silver, lead, bismuth, gold, or alloys thereof. In some embodiments, weights 250 may be formed of a material having a density of approximately 0.4 $lb/in^3$, such as lead.

Monofilament 260 may be formed of any continuous fiber that may fit through the center of weights 250 or over which a wire can be extruded and that has high tensile strength, including, but not limited to, polyester, nylon, polyvinylidene fluoride, polyethylene, polyethylene terephthalate, ultra-high-molecular-weight polyethylene (UHMWPE) or aramids.

In another embodiment, weighted core 210 may be formed by extruding a wire over monofilament 260 and crimping the wire to form equally spaced segments held together by monofilament. The equally spaced segments form weights 250.

Weights 250 may be evenly spaced along monofilament 260, and monofilament 260 may run through the center of weights 250. Distance 410 between weights 250 may be adjusted to result in rope 200 having more or less mass. For example, to make rope 200 heavier, distance 410 may be smaller and weights 250 spaced more closely together. Likewise, to make rope 200 lighter, distance 410 may be larger and weights 250 placed further apart. To maintain distance 410, knots may be added to monofilament 260 to prevent weights 250 from sliding. Alternatively, weights 250 can be alternated with lighter weights that serve as spacers. These lighter weights may be formed of any material having a low density. This low-density material may be plastic, such as polyethylene, polypropylene, or polyvinyl chloride, a low-density metal, such as aluminum, a synthetic material, a synthetic rubber, polycarbonate, or nylon. The material used to form weights 250 may also change the mass of rope 200, as a denser or less dense metal may be used depending on the desired mass of rope 200.

Figure 5A:
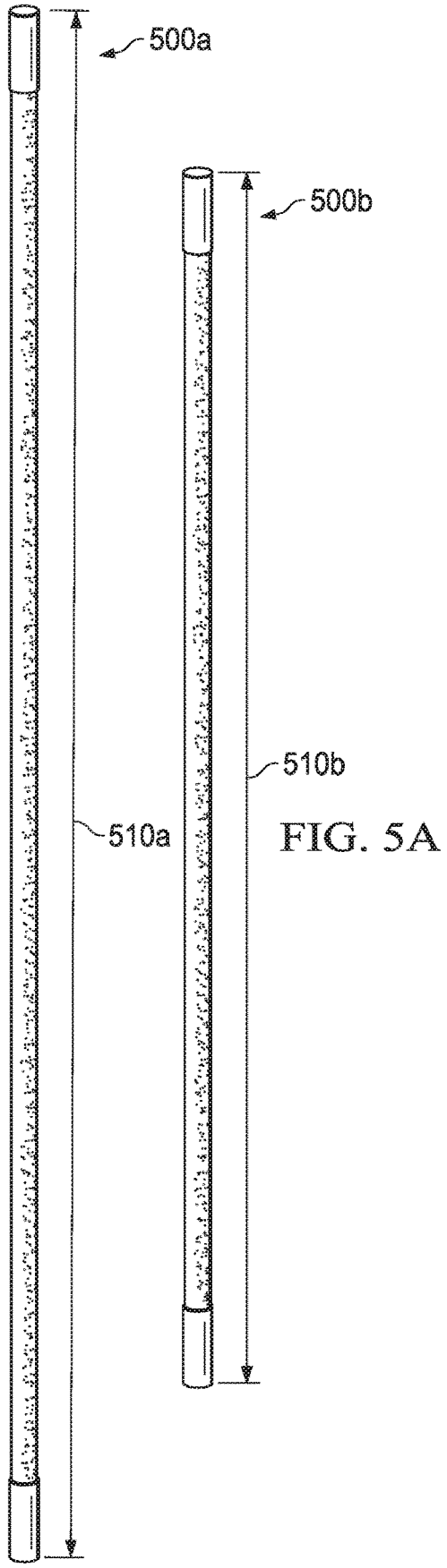
FIG. 5A is a perspective view of a plurality of exercise ropes, where the exercise ropes have different lengths.

FIG. 5A is a perspective view of a plurality of exercise ropes where the exercise ropes have different lengths. The exercise ropes in FIG. 5A have the same characteristics as triple-braided exercise rope 200. The plurality of exercise ropes may include first exercise rope 500*a* and second exercise rope 500*b*. First exercise rope 500*a* and second exercise rope 500*b* each have a length. Length 510*a* of the first exercise rope 500*a* may be different than length 510*b* of the second exercise rope 500*b*.

Figure 5B:
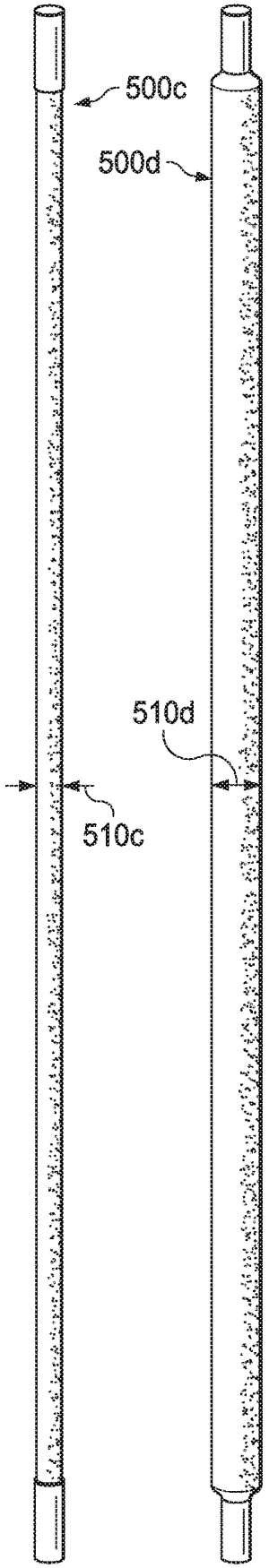
FIG. 5B is a perspective view of a plurality of exercise ropes, where the exercise ropes have different diameters.

FIG. 5B is a perspective view of a plurality of exercise ropes where the exercise ropes have different diameters. The exercise ropes in FIG. 5B have the same characteristics as triple-braided exercise rope 200. The plurality of exercise ropes may include first exercise rope 500*c* and second exercise rope 500*d*. First exercise rope 500*c* and second exercise rope 500*d* each have a diameter. Diameter 510*c* of the first exercise rope 500*c* may be different than diameter 510*d* of the second exercise rope 500*d*.

In other embodiments, several dimensions of the first and second exercise ropes described in FIGS. 5A and 5B may vary. For example, both the length and diameter of the first exercise rope may be different than both the length and diameter of the second exercise rope.

Figure 6:
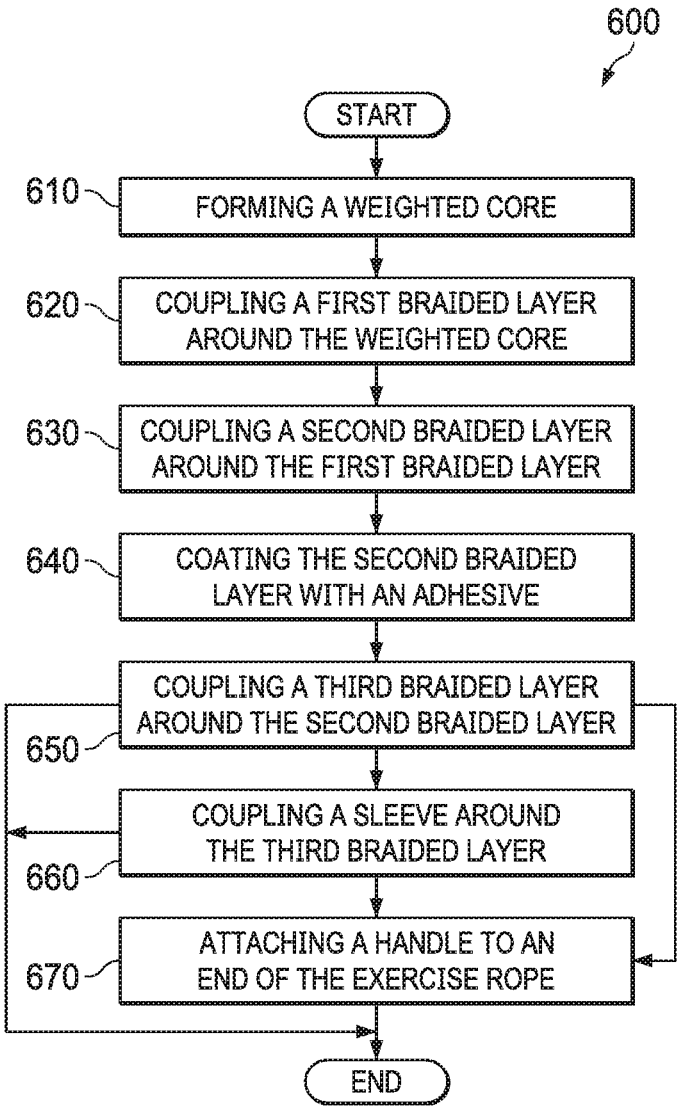
FIG. 6 is a flow chart depicting a method of manufacturing a triple-braided exercise rope.

FIG. 6 shows a flow chart of a method of manufacturing exercise rope 200. First, at step 610, method 600 may include forming a weighted core. The weighted core may be formed by adding weights to a monofilament, as shown in more detail in FIG. 4. In embodiments, the weighted core may be formed by extruding a wire over a monofilament and crimping the wire to form equally spaced segments held together by the monofilament.

Then, at step 620, method 600 may include coupling a first braided layer around the weighted core. For example, the first braided layer may be interwoven tightly to close gaps between the interwoven yarns and may be braided to form a tight cover around the weighted core. The first braided layer may be made of multiple yarns interwoven together to form a braid. The first braided layer may have yarns of a first ply, where the ply is between one and three yarns that are interwoven together.

Next, at step 630, method 600 may involve coupling a second braided layer around the first braided layer. For example, the second braided layer may be braided over the first braided layer and may be interwoven tightly to close gaps between the interwoven yarns. The second braided layer may have yarns of a second ply. The second ply may be higher than the first ply, resulting in a thicker second braided layer.

Then, at step 640, method 600 may involve coating the second braided layer with an adhesive, as described in more detail in FIG. 3, to prevent the second braided layer from rupturing through the third braided layer when the exercise rope is in use. The adhesive may be a material that has a high cohesive strength, flexibility, and the ability to adhere to the second braided layer. For example, the adhesive may be glue, polyurethane, or cyanoacrylate.

Finally, at step 650, method 600 may involve coupling a third braided layer around the second braided layer. For example, the third braided layer may be braided over second braided layer, coated with adhesive to bond the two layers together, and may be interwoven tightly to close gaps between the interwoven layers. The third braided layer may have yarns of a third ply. The third ply may be higher than the second ply, resulting in a thicker braided layer. Half the yarns of the third braided layer may be twisted in a clockwise direction, and the other half of the yarns may be twisted in a counterclockwise direction.

Method 600 may further include one or both of steps 660 and 670. At step 660, method 600 may further involve coupling a sleeve around the third braided layer. The sleeve may cover the entire length of the exercise rope. It may also cover only portions of the exercise rope. For example, as shown in FIG. 1C, the sleeve may cover an area surrounding the midpoint of the exercise rope. This may help the user identify the midpoint. Additionally, the sleeve may convey information to the user. The sleeve may be secured to exercise rope by applying heat. For example, the sleeve may be secured to the exercise rope via a shrink-wrapping process.

At step 670, method 600 may further involve attaching a handle to an end of the exercise rope. This step may involve seizing the rope ends with twine and coating with polyurethane. The handles may then be secured to the ends of the exercise rope by applying heat. For example, the handles may be secured to the ends of exercise rope via a shrink-wrapping process. Additionally, the handles may convey information to the user.

Modifications, additions, or omissions may be made to method 600 without departing from the scope of the present disclosure. For example, the order of the steps may be performed in a different manner than that described, and some steps may be performed at the same time. Additionally, each individual step may include additional steps without departing from the scope of the present disclosure.

Although the disclosure provides numerous examples, the scope of the present disclosure is not so limited. Rather a wide range of modification, change, and substitution is contemplated in the foregoing disclosure. It is understood that such variations may be made to the foregoing without departing from the scope of the present disclosure.

What is claimed is:

1. An exercise rope, comprising:

a weighted core;

a first braided layer surrounding the weighted core, the first braided layer having yarns of a first ply;

a second braided layer surrounding the first braided layer, the second braided layer having yarns of a second ply, the second ply being higher than the first ply;

an adhesive coating the second braided layer; and a third braided layer surrounding the second braided layer, the third braided layer having yarns of a third ply, the third ply being higher than the second ply, wherein half the yarns of the third braided layer are twisted in a clockwise direction and half the yarns of the third braided layer are twisted in a counterclockwise direction.

2. The exercise rope of claim 1, wherein the weighted core includes a plurality of weights on a monofilament.

3. The exercise rope of claim 2, wherein each of the plurality of weights has a density of between 0.1 $lb/in^3$ and 0.6 $lb/in^3$, inclusive.

4. The exercise rope of claim 1, further comprising a handle attached to an end of the exercise rope.

5. The exercise rope of claim 1, further comprising a sleeve surrounding the third braided layer.

6. The exercise rope of claim 5, wherein the sleeve covers a midpoint of the exercise rope.

7. The exercise rope of claim 5, wherein the sleeve includes a plastic or a rubber material.

8. The exercise rope of claim 1, wherein the exercise rope has a mass of between one pound per foot of rope and approximately 2.5 pounds per foot of rope, inclusive.

9. A plurality of exercise ropes, each of the plurality of exercise ropes comprising:

a weighted core;

a first braided layer surrounding the weighted core, the first braided layer having yarns of a first ply;

a second braided layer surrounding the first braided layer, the second braided layer having yarns of a second ply, the second ply being higher than the first ply; and a third braided layer surrounding the second braided layer, the third braided layer having yarns of a third ply, the third ply being higher than the second ply, wherein half the yarns of the third braided layer are twisted in a clockwise direction and half the yarns of the third braided layer are twisted in a counterclockwise direction;

wherein the second braided layer is coated with an adhesive; and wherein the plurality of exercise ropes includes a first exercise rope and a second exercise rope, each first exercise rope and second exercise rope having a dimension, the dimension of the first exercise rope being different than the dimension of the second exercise rope.

10. The plurality of exercise ropes of claim 9, wherein the dimension is a length or a diameter.

11. The plurality of exercise ropes of claim 9, wherein each of the plurality of exercise ropes further comprises a sleeve surrounding the third braided layer.

12. The plurality of exercise ropes of claim 9, wherein each of the plurality of exercise ropes further comprises a handle attached to an end of each of the plurality of exercise ropes.

13. The plurality of exercise ropes of claim 9, wherein the weighted core includes a plurality of weights on a monofilament.

14. The plurality of exercise ropes of claim 13, wherein each of the plurality of weights has a density of between 0.1 $lb/in^3$ and 0.6 $lb/in^3$, inclusive.

15. The plurality of exercise ropes of claim 9, wherein each of the plurality of exercise ropes has a mass of between one pound per foot of rope and approximately 2.5 pounds per foot of rope, inclusive.

16. A method of manufacturing an exercise rope, comprising:

forming a weighted core;

coupling a first braided layer around the weighted core, the first braided layer having yarns of a first ply;

coupling a second braided layer around the first braided layer, the second braided layer having yarns of a second ply, the second ply being higher than the first ply;

coating the second braided layer with an adhesive; and coupling a third braided layer around the second braided layer, the third braided layer having yarns of a third ply, the third ply being higher than the second ply, wherein half the yarns of the third braided layer are twisted in a clockwise direction and half the yarns of the third braided layer are twisted in a counterclockwise direction.

17. The method of manufacturing an exercise rope of claim 16, further comprising coupling a sleeve around the third braided layer.

18. The method of manufacturing an exercise rope of claim 16, further comprising attaching a handle to an end of the exercise rope.

19. The method of manufacturing an exercise rope of claim 16, wherein the weighted core is formed by adding weights to a monofilament.

20. The method of manufacturing an exercise rope of claim 16, wherein the weighted core is formed by extruding a wire over a monofilament and crimping the wire.

* * * * *